US005147221A

United States Patent [19]

Cull et al.

[11] Patent Number: 5,147,221

[45] Date of Patent: Sep. 15, 1992

[54] COMBINATION SOCKET AND WINGLESS CABLE-END RADIO PIN CONNECTOR

[75] Inventors: Robert R. Cull, Brecksville; Walter Cizek, Brooklyn, both of Ohio

[73] Assignee: The Starling Manufacturing Company, Cleveland, Ohio

[21] Appl. No.: 689,672

[22] Filed: Apr. 23, 1991

Related U.S. Application Data

[63] Continuation of Ser. No. 393,941, Aug. 13, 1989, abandoned.

[51] Int. Cl.[5] ..... H01R 17/04

[52] U.S. Cl. ..... 439/585; 439/675; 439/846

[58] Field of Search ..... 439/578–585, 439/675, 668, 669, 851–857, 607, 610, 324, 63, 842, 843, 846

[56] References Cited

U.S. PATENT DOCUMENTS

| | | | |
|---|---|---|---|
| 3,206,540 | 9/1965 | Cohen | 439/578 |
| 3,335,388 | 8/1967 | Karol | 439/610 |
| 3,538,491 | 7/1968 | Longnecker et al. | 439/851 |
| 4,017,139 | 4/1977 | Nelson | 439/675 |
| 4,326,769 | 4/1982 | Dorsey et al. | 439/578 |
| 4,374,606 | 2/1983 | Lathrop | 439/843 |
| 4,377,320 | 3/1983 | Lathrop et al. | 439/585 |
| 4,453,796 | 6/1984 | Monroe | 439/585 |
| 4,545,633 | 10/1985 | McGeary | 439/675 |
| 4,598,961 | 7/1986 | Cohen | 439/63 |
| 4,619,496 | 10/1986 | Forney, Jr. et al. | 439/675 |

FOREIGN PATENT DOCUMENTS

| | | | |
|---|---|---|---|
| 2917111 | 11/1980 | Fed. Rep. of Germany | 439/63 |

*Primary Examiner*—David Pirlot

*Attorney, Agent, or Firm*—Fay, Sharpe, Beall, Fagan, Minnich & McKee

[57] ABSTRACT

In a detachable connector a socket assembly with a hollow body is provided. The inner walls of the hollow body define a cylindrical chamber having at least one opening. Also provided in the detachable connector is a pin assembly. The pin assembly includes a pin body attached to a cable sleeve having a groove extending throughout its circumference. The pin body is inserted into the open end of the socket assembly's chamber. A cylindrical metal contact sleeve is axially received in the chamber, the metal contact sleeve having axially spaced circumferential portions. These portions are constrained by the chamber wall. The metal contact sleeve also has detents that extend radially inward to engage the cable sleeve groove, when the pin body is received in the chamber.

9 Claims, 4 Drawing Sheets

COMBINATION SOCKET AND WINGLESS CABLE-END RADIO PIN CONNECTOR

This is a continuation of application Ser. No. 393,941, filed Aug. 13, 1989 now abandoned.

BACKGROUND OF THE INVENTION

This invention pertains to the art of detachable connectors and more particularly to a detachable electrical cable connector. The invention is particularly applicable for use as a coaxial cable connector for maintaining electrical continuity between a socket and a wingless cable-end radio pin connector and will be described with reference thereto. However, it should be appreciated that the invention has broader applications and may be advantageously employed in still other detachable connector environments and applications.

One structural arrangement which addresses a single conductor type of connector is described in U.S. Pat. No. 2,659,876 to Dupre, et al. which issued Nov. 17, 1953. Dupre, et al. shows a connector having an oval-shape spring element which is split at one end to produce two spaced, free ends and a somewhat U-shape. There is sufficient clearance between the spring elements and the inner surface of a connector body to permit the legs of the U-shape spring element to be spread apart by insertion of a plug or pin member. The spreading is generally in the nature of a lateral pivoting of the legs of the U.

The legs of the U-shape spring element each include an embossed portion that is adapted to engage a groove located on the plug or pin member. The embossed portions are formed at transversely aligned positions on each side of the spring to form a pair of inter-engaging detents for receiving the plug member.

There are a number of disadvantages inherent in the Dupre connector. The spring element has an oval configuration which engages the pin groove with its embossed portions at only two locations. This occurs due to the manner in which the element spreads in opening. Specifically, as the spring is axially spread, each of the legs move in opposite directions away from the center axis of the spring element Such movement reduces the amount of surface capable of being engaged by the pin groove. This arrangement, in which the body and pin only engage in two locations, increases the amount of wobble and movement which occurs between the body and plug member.

In a coaxial type arrangement, however, centering of the inner conductor is essential and wobble, as mentioned above, creates an unacceptable contacting arrangement.

A further disadvantage of the single conductor connector of Dupre is that a minimum amount of locking is afforded since the spring element contacts the plug at only two locations. This type of contact does not afford positive locking of the plug within the socket. In fact, Dupre recognizes the absence of positive locking when he provides for a locking screw 43 which is disposed within the body and which, when tightened, abuts against the side of the spring forcing the spring into engagement with the plug. The use of a locking screw, however, has several disadvantages not the least of which is the inability to assemble and disassemble the connector in confined spaces.

A coaxial connector is described in U.S. Pat. No. 4,377,320 to Lathrop, et al. which issued Mar. 22, 1983.

Lathrop, et al. describes a connector employing inner and outer spring fingers that meet with and engage a groove located on the plug member. The spring fingers are defined as U-shaped leaf springs with an outer leaf of each finger contacting the hood of the shell body. As the plug member is inserted into the spring fingers, they are spread outwardly against the hood portion, thereby putting the spring leaves under a compressive force which serves the purpose of making mechanical and electrical contact.

To effect the Lathrop interconnection, a detailed preparation of the sleeve, including the spring fingers, must be undertaken. These preparatory steps all increase time and labor for installing the connector device increasing the cost of installation. Further, adjustment to the force required to either insert or detach the connection is not readily achievable.

The connector of Lathrop is relatively expensive to manufacture and includes component parts which are, in some respects, relatively complex requiring extensive machining operations. This may be due, in part, to the fact that the Lathrop connector is designed to meet prescribed military specifications (see Column 1, line 65). A further disadvantage of the Lathrop connector is the fact that it presents a relatively large connector profile. While Lathrop describes his connector profile as being smaller than prior art connector profiles (Column 1, line 64), it is to be noted from the Lathrop drawings that his connector has a diameter of at least twice that of the coaxial cable received in the connector. While the Lathrop coaxial connector may define a connector profile that is less than some prior art connectors, it is still, nevertheless, relatively large when considering the diameter of the coaxial cable received in the connector.

The subject invention is deemed to overcome these problems and others in a simplified, easy to install connector which is economical to manufacture and which presents a relatively small connector profile.

SUMMARY OF THE INVENTION

According to the present invention, there is provided a detachable connector including a socket assembly with a hollow body. The inner walls of the hollow body define a generally cylindrical chamber with at least one axially open end. The detachable connector also includes a pin assembly having a cylindrical pin plug with a circumferentially-extending external groove. The pin plug is sized for insertion through the open end of the socket assembly for receipt into the socket assembly chamber. Confined in the chamber is a generally cylindrical metal contact sleeve which has axially spaced circumferential end portions that are radially and axially constrained by the inner wall of the socket's chamber. The sleeve also has a plurality of integral spring contacts which extend axially between the circumferential end portions. At least some of the spring contacts may carry integral detents extending radially inward so as to engage the cable sleeve groove when the pin plug is received in the chamber.

According to another aspect of the invention, the contact sleeve has an axial dimension such that when received in the socket, sufficient axial clearance is provided so that the contact sleeve can expand axially when the spring contacts are compressed by insertion of the pin plug.

According to yet another aspect of the invention, the contact sleeve includes a plurality of spring contacts spaced throughout its circumference. The spring contacts independently move in a radial manner, such that a spring force is applied to the pin plug upon its insertion into the socket. The spring force of each independently acting spring contact is used to maintain the socket assembly and the pin plug in a secured interconnection.

Because of design of the contact sleeve and its relationship to the socket chamber, the spring contacts engage with substantial force completely about the contact sleeve. This eliminates the problems which result from the previously described prior art U-shaped spring element. Moreover, the manner in which the circumferential portions of the contact sleeve are radially constrained by the inner walls of the socket chamber further stabilize the connection between the spring fingers and the connector pin.

A principal advantage of the invention, when used to carry very small currents which subsequently must be amplified many times, resides in the elimination of wobble in the connection between the connector pin and the spring contacts, thereby minimizing contact resistance and electrical noise.

A further advantage of the invention is in the smooth surface provided on the cable pin plug. Such a surface allows attachment and detachment of the cable while avoiding injury to the party making the connection. The use of wings or barbs characteristic of many prior art electrical connectors has been eliminated in the connector of this invention.

Another advantage of the invention resides in the ability of the contact sleeve to modify present socket installations for use with the present invention.

Another advantage is the relatively small size of the invention making it suitable for use in miniaturized assemblies.

A still further advantage of the small size and economical design of this invention is the low cost of the invention compared to more complicated prior art connectors. For example, the connector of this invention can be manufactured at considerably lower cost than the connector shown in the patent to Lathrop, U.S. Pat. No. 4,377,320.

Still another advantage of the invention is in the ability to readily vary the amount of force necessary for insertion and detachment.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail with this specification and illustrated in the accompanying drawings which form a part hereof, and wherein.

DETAILED DESCRIPTION OF THE PREFERRED EMBODIMENT

Figure 1:
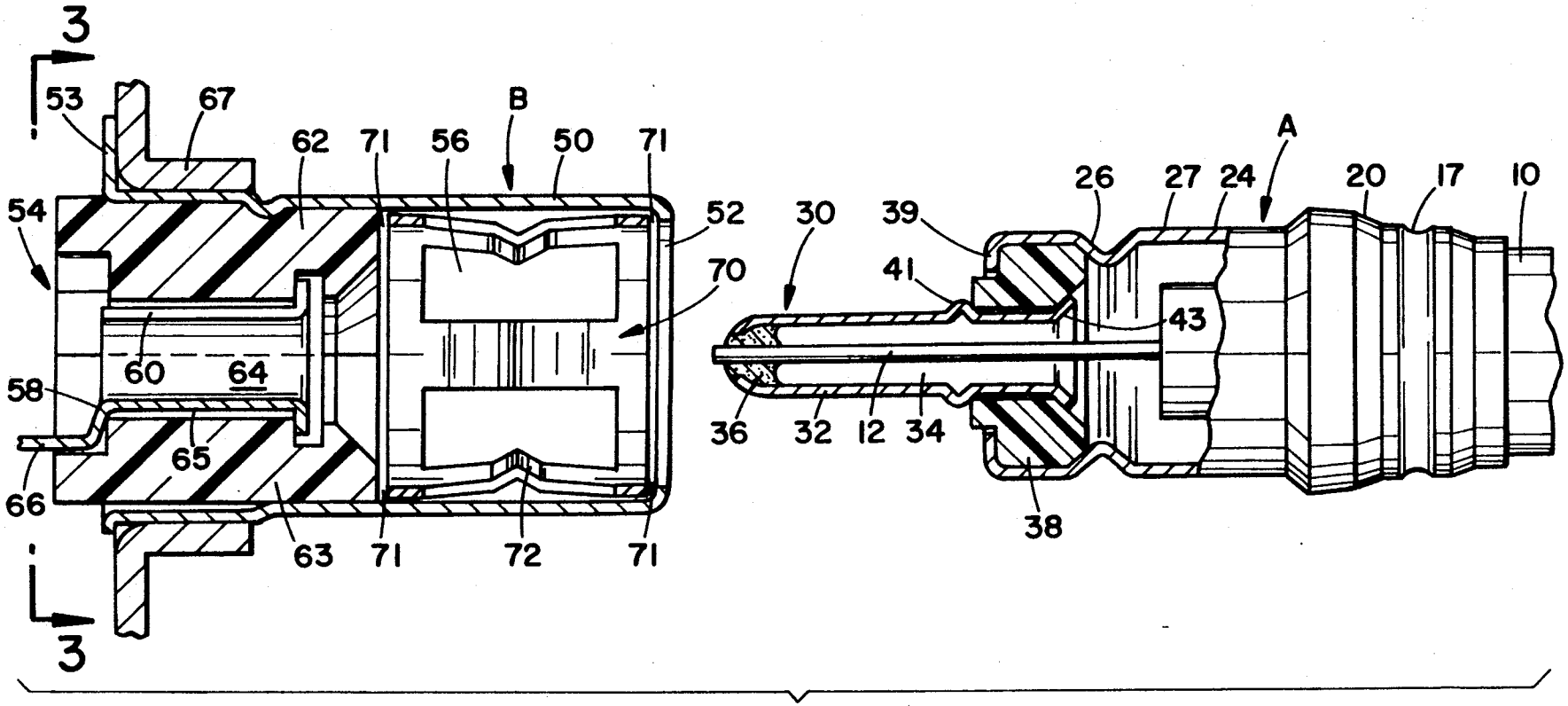
FIG. 1 is a side elevational view of a pin plug assembly and a pin socket assembly with selected portions broken away to illustrate the position and cooperation of various elements of the assemblies.

Referring now to the drawings wherein the showings are for purposes of illustrating the preferred embodiment of the invention only and not for purposes of limiting same.

FIG. 1 illustrates the major component parts of the present invention comprising pin plug assembly A and the socket assembly B.

Figure 2:
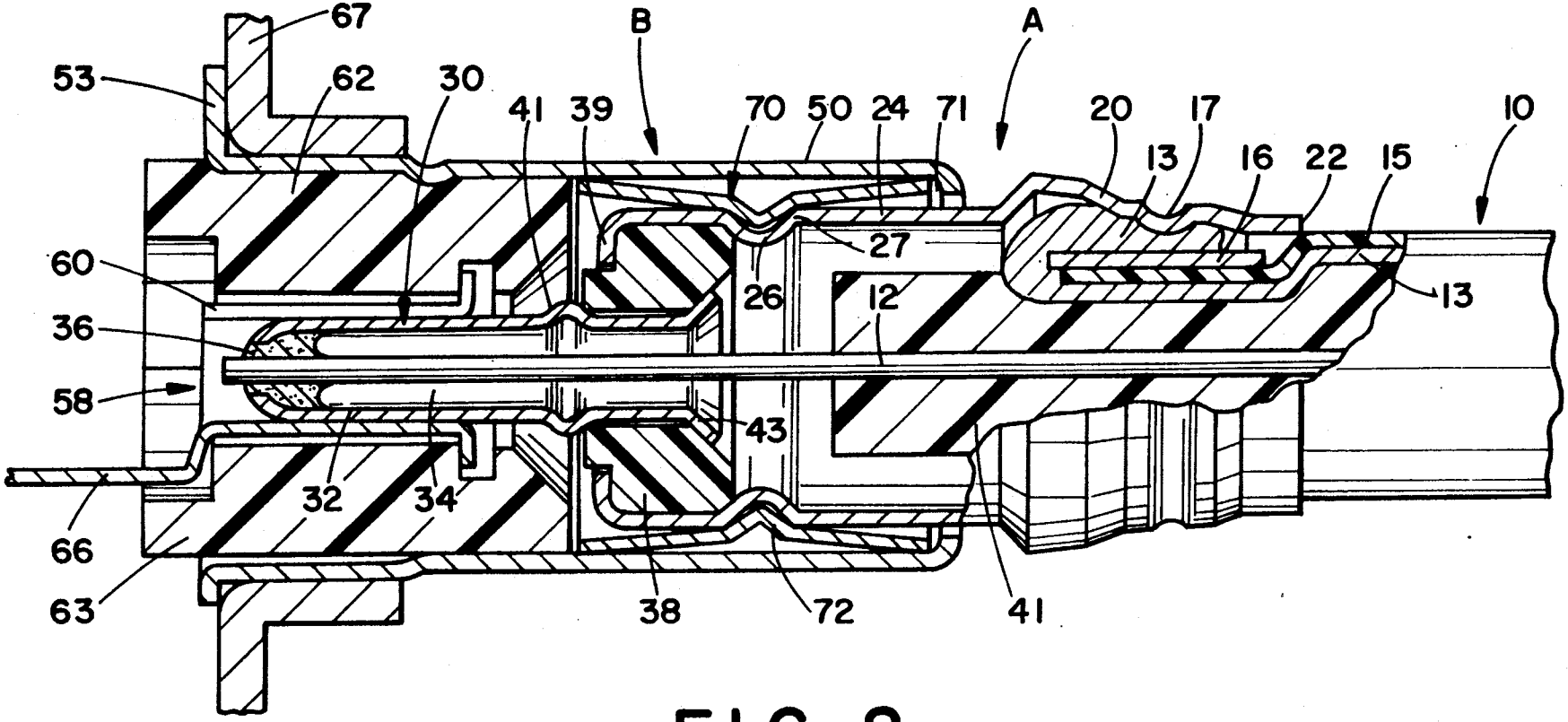
FIG. 2 is a side elevational view of the pin plug assembly and the socket assembly of FIG. 1 shown interconnected with selected portions broken away to illustrate the position and cooperation of the various elements of the assemblies.
Figure 4:
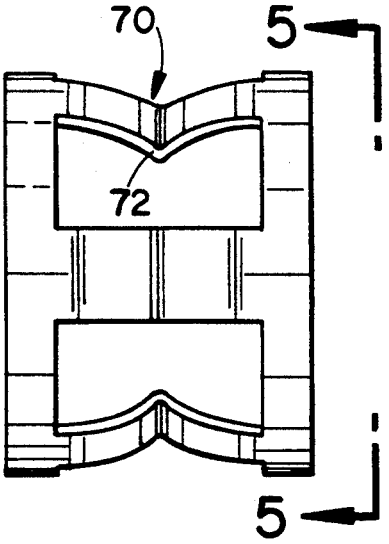
FIG. 4 is a side elevational view of the contact sleeve.

FIG. 2 illustrates the pin plug assembly A and socket assembly B when interconnected.

Referring to both FIGS. 1 and 2, a pin plug assembly A is securely crimped to coaxial cable 10 to provide a mechanical and electrical connection between the pin plug assembly and both the inner and outer conductors of the coaxial cable. More particularly, with reference to FIG. 2, the cable sleeve 20 has a posterior opening 22 which receives the coaxial cable 10.

The coaxial cable 10, as is well known, includes an inner conductor 12 and an outer conductive sheath 13. Insulation 14 separates the inner conductor 12 from the outer conductive sheath 13. Exterior jacketing 15 covers the outer conductive sheath 13.

As best seen in FIG. 2, a metallic grounding sleeve 16 is placed over the cut end of jacketing 15. The free end of the outer conductive sheath 13 is turned over the grounding sleeve 16. The cable sleeve 20 is crimped into engagement with the outer conductive sheath 13 and the grounding sleeve 16 to make a secure electrical connection between the able sleeve 20 and the outer conductive sheath 13. In turn, the crimp which is shown at 17 in FIG. 2 provides a secure mechanical connection between the cable sleeve 20 and the coaxial cable 10.

The crimping may vary in form and manner but it must typically satisfy a pull-test specification of ninety newtons.

The conductor cable sleeve 20 is provided with a radially projecting extension 24 having a smooth continuous cylindrical outer surface with an annular circumferentially extending groove 26 located in its body. The annular groove 26 is continuous about the entire circumference of the cable sleeve extension 24 and has a constant depth and cross-sectional configuration.

A radio pin 30 is carried at the anterior end of the pin plug assembly A. The pin 30 has exterior walls 32 of a substantially cylindrical configuration which define an inner hollow region 34. The radio pin 30 further has anterior and posterior openings. The posterior opening allows for the entry of the inner conductor 12 into the radio pin hollow region 34. The anterior opening of radio pin 30 allows for the attaching of the inner conductor 12 in a secured position. Specifically, the inner conductor 12 is passed through the small opening at the anterior of the radio pin 30 then solder 36 is applied to secure the inner conductor 12 to the radio pin 30.

The solder 36 must wick at least 2.0 mm (0.08 inches) up into the pin's hollow region 34 during soldering. The end of the inner conductor 12 is to be visible within the solder joint. The center line of the radio pin 30 is to be within ±0.5 mm of the center line of the pin assembly A. The solder to be used can be a type of metal GM 6023M Grade 60A flux and is to be of a non-corrosive type.

As an alternative to the use of solder, a mechanical crimp-type connection can be employed to secure the inner conductor 12 to the pin 30. Alternate means of connecting the inner conductor 12 to the pin 30 may be used as well.

Radio pin 30 is positively connected with the remainder of pin assembly A through a relatively rigid insulation disk 38. As illustrated in FIGS. 1 and 2, the disk 38 is mechanically captured between the groove 26 and a flange 39 formed on the anterior end of the pin plug. The pin is held in the disk 38 by a circumferential projection 41 and an outwardly curled end 43 which engage opposite faces of disk 38 as shown in FIGS. 1 and 2.

Socket assembly B, the second major component of the invention, includes a metal sleeve 50 having an anterior opening 52 and a posterior opening 54. The sleeve's substantially cylindrical conformation of the preferred embodiment defines an inner hollow region 56. The sleeve's anterior opening 52 is defined by an inwardly curved reduced end, such that the opening consists of a smaller diameter than the hollow region 56 of metal sleeve 50.

A contact 58 is received within metal sleeve 50. The contact 58 consists, in part, of a split ring portion 60. The split ring portion 60 is kept in position through the use of a pair of semi-cylindrical insulation members 62, 63 which surround the split ring 60. In a modified form of the invention, a one-piece insulation member may be used. The insulation members 62, 63 also insulate the split ring 60 from the inner walls of metal sleeve 50. The substantially cylindrical conformation of split ring 60 creates a split ring hollow region 64 defined by the split ring's inner walls.

As may be seen in FIGS. 1 and 2, a clearance 65 is provided between the outer walls of split ring 60 and the internal walls of insulation members 62 and 63. This clearance permits the split ring 60 to float enabling it to expand outwardly when the radio pin 30 is received within the split ring.

Contact 58 further includes a tail portion 66 which leads away from the socket assembly B and is used to connect the present invention with outside devices. The tail portion 66 is a thin, rigid extension of the split ring 60.

In the front section of the socket assembly B, a contact sleeve 70 is placed within the socket's defined hollow region 56. The contact sleeve 70 has a plurality of detents 72, wherein the apex of the detents face into the interior of the defined hollow region 56. A more detailed discussion of the contact sleeve 70 will be treated with accompanying FIGS. 4–8.

Bracket 67 is shown in FIGS. 1 and 2 adjoining the outer surface of metal sleeve 50 so that socket assembly B can be permanently attached to a chosen surface.

Figure 3:
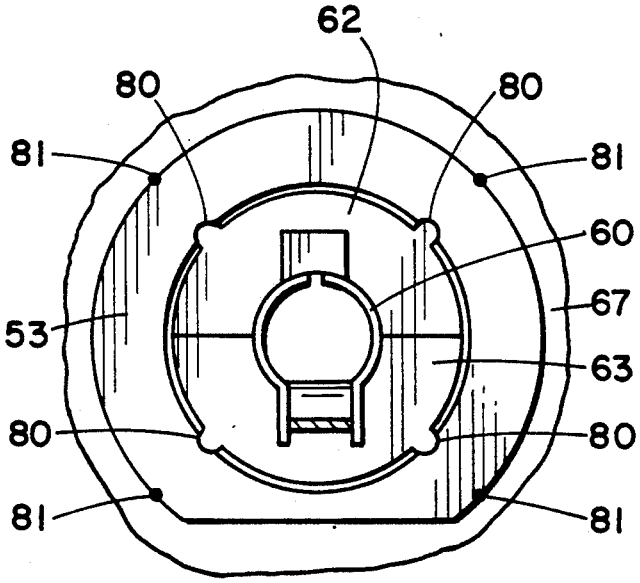
FIG. 3 is an end elevational view taken on line 3—3 of FIG. 1.

In FIG. 3, a rear view of socket assembly B shows the insulation members 62, 63 which separate the split ring 60 of the contact 58 from the inner wall of metal sleeve 50. In the preferred embodiment, the insulation members 62 are formed with four holding projections or ribs 80 which are press-fitted into the interior of metal sleeve 50. This feature holds the insulation members 62, 63 in a secured position eliminating rotational movement of the insulation members and thereby, in turn, maintaining the contact 58 in a fixed position.

Alternate attachment means may be used including an interference fit between the members, the use of a taper lock, the use of adhesives, and other means well-known to those skilled in the art.

The end flange 53 of the sleeve 50 is spot-welded to the bracket 67 at the four places where indicated in FIG. 3 at 81. Alternate attachment means may be used including an interference fit between the members, the use of a taper lock, the use of adhesives and other means well-known to those skilled in the art.

Alternative attaching means for securing the end flange 53 to bracket 67 may be employed including a press-fit engagement of the sleeve 50 with bracket 67, the use of a taper lock between the sleeve and the bracket, the use of adhesives, and the application of an external compression force on the bracket 67 forcing it into engagement with the sleeve 50.

In an alternate form of the invention, the flange 53 may be eliminated and the metal sleeve 50 secured to the bracket 67 by a press fit or other attachment means.

The contact sleeve 70, previously mentioned, will now be discussed in greater detail with reference to FIGS. 4–7. The contact sleeve 70 is constructed of a phosphorous bronze sheet of a class 2 hardness 0.2 mm thick, with a tin finish being 0.0025 mm minimum thickness. In alternate embodiments, the contact sleeve may be fabricated from stainless steel and other spring-tempered materials.

Figure 6:
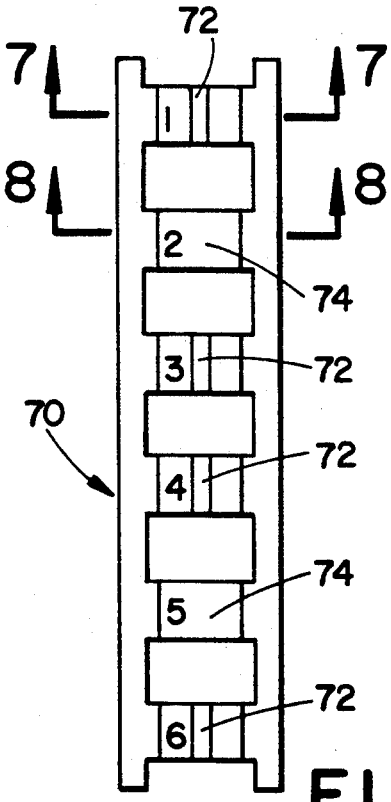
FIG. 6 is a top elevational view of the contact sleeve in an essentially planar configuration after stamping, but before rolling into a cylindrical configuration.

As shown in FIG. 6, contact sleeve 70 is initially formed as a rectangular blank where portions of the bronze sheeting have been removed through a stamping or other process. The length of the contact sleeve in a pre-rolled state is 22 mm with 3.7 mm spacing between each of the six detents.

Figure 5:
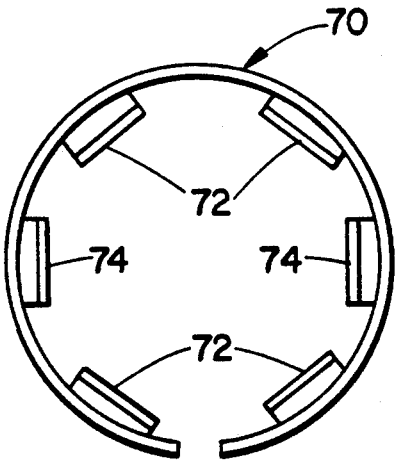
FIG. 5 is an end elevational view of the contact sleeve taken on line 5—5 of FIG. 4.

FIG. 5 shows the contact sleeve 70 in its manufactured form after having been rolled into a round configuration after stamping. The contact sleeve is formed such that the apexes of the detents point inwardly toward the center of the contact sleeve. The contact sleeve in the preferred embodiment is a split ring type configuration with a diameter of 6.2 mm.

Figure 8:
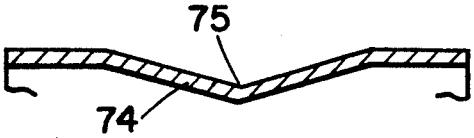
FIG. 8 is a partial cross-sectional view taken on line 8—8 of FIG. 6 and illustrating a wiping spring contact of the contact sleeve.
Figure 7:
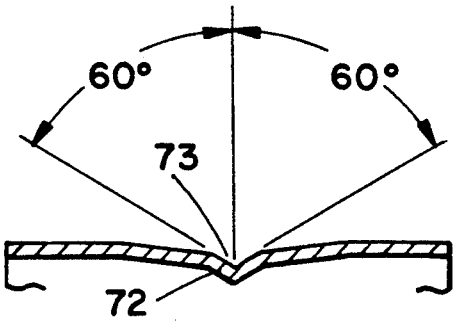
FIG. 7 is a partial cross-sectional view taken on line 7—7 of FIG. 6 and illustrating the spring contact elements of the contact sleeve.

As best seen in FIGS. 6, 7, and 8, the contact sleeve 70 is provided with two different types of detents. Cross-sectional views of the two different types of detents are shown in FIGS. 7 and 8.

With reference to FIGS. 6 and 7, the contact sleeve 70, in the preferred embodiment, is provided with four detents 72 which have the configuration in cross-section of FIG. 7. Detents 72 are formed at an angle of 60° from a vertical reference plane. It is contemplated that alternate angles (other than 60° angles) may be used as will be described further below.

With reference, once again, to FIG. 6, it will be seen that contact sleeve 70, in its rectangular configuration prior to rolling, is defined by a total of six detent stations which have been numbered 1–6 in FIG. 6. Stations 1, 3, 4, and 6 are provided with detents 72 in the configuration shown in cross-section in FIG. 7. Alternately, stations 2 and 5 are provided with wiping detents 74 which are in the configuration shown in cross-section in FIG. 8.

As will be seen from a comparison of FIGS. 7 and 8, detent 72 presents a sharper configuration than wiping detent 74. Detent 72 is defined with an included half angle of 60° from a vertical plane with the internal radius of the detent (shown at 73 in FIG. 7) being kept at a minimum. On the other hand, the internal radius 75 of detent 74 (FIG. 8) is less sharp than radius 73 being approximately 1 mm.

It has been found that the intermixing of detents 72 and 74 in the six station contact sleeve 70 provides both secure mechanical interconnection of the pin plug assembly with the socket assembly and, in addition, good, low resistance electrical interconnection between these assemblies. Detents 72 of FIGS. 7 provides for firm, positive locking engagement of the contact sleeve 70 with the pin plug assembly. On the other hand, detents 74 of FIG. 8 provides for good wiping contact of the contact sleeve with the pin plug assembly affording an excellent, low-resistance electrical connection to be made between these elements.

Figure 10:
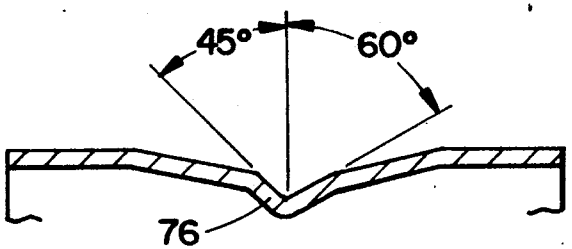

FIG. 10 shows a cross-sectional view of a modified detent 76 of the contact sleeve. Whereas detent 72 of FIG. 7 is defined by included half angles of 60° from a vertical plane, detent 76 of FIG. 10 is defined by half angles of both 45° and 60° from a vertical plane.

The ability to vary the angles defining the detent allows the force necessary to insert or detach the pin assembly A from the socket assembly B to be varied. When both sides of the detent have the same ramp angle, as in FIG. 7, the contact sleeve 70 may be placed within metal sleeve 50 without regard to direction. The pull-out and insertion forces are approximately equal. When the angle is varied, such as shown in FIG. 10, the contact sleeve 70 becomes a uni-directional device in that the direction in which it is inserted will have an effect upon the operation of the detachable connector.

Specifically, by altering the half angle as shown in FIG. 10, and assuming that the pin in inserted from right to left in FIG. 10, the 60° ramp will be the first to engage the pin. The 45° ramp will resist pull-out of the pin. Thus, it will take less force to assemble the pin and socket assemblies, using the detent of FIG. 10, than it will take to disengage the pin and socket assemblies. This is due to the fact that the 45° ramp angle, which must be overcome for disconnection of the pin and socket assemblies, is steeper than the 60° angle ramp. Therefore, less resistance must be overcome to attach the two assemblies than to detach the assemblies.

FIG. 10 is illustrative of the variations that may be employed in shaping the detents of the contact sleeve. Ramp angles in both the insertion and disconnect directions may be varied and, as noted in FIGS. 7 and 10, need not be equal.

The detent 74 of FIG. 8 illustrates that the invention contemplates the use of less sharp detents or detents which are defined on a small radius to afford a wiping contact of the detent with the pin plug assembly.

Upon insertion of the contact sleeve 70 into metal sleeve 50, the contact sleeve 70 takes on an essentially circular form, thereby causing the associated detents 72 and 74 to be positioned in an essentially circular configuration as is shown in FIG. 5. The detents act substantially independently from each other and, as indicated above, are defined to provide a spring-like force against the pin plug assembly when inserted.

As best seen in FIG. 1, the detents 72 do not lie flat against the interior wall of metal sleeve 50. Rather, there is space between the detents and the socket inner wall allowing for a spring-like action as the plug assembly is inserted into the socket assembly. More particularly, upon insertion of the pin plug assembly into the socket assembly, each of the independently-acting detents moves radially outwardly to allow the pin plug assembly to pass whereafter the detents will spring forward to engage the pin plug assembly.

An axial clearance 71 is advantageously provided between the contact sleeve and the anterior opening 52 and insulation members 62, 63. This axial clearance enables the contact sleeve 70 to expand axially when the pin plug assembly is inserted into the socket assembly and engagement of these members takes place.

FIG. 2 shows the detachable connector of the present invention in an engaged position. Specifically, pin plug A is engaged with socket assembly B. The pin plug is moved into the socket hollow region 56 until the plurality of detents 72, 74 engage the annular groove 26 of the pin plug assembly A as well as the adjoining wall 27 of the pin plug assembly. At the same time, pin 30 moves into and engages the contact 58. In the preferred embodiment, the interconnection of the pin plug assembly A and the socket assembly B provides for seven points of contact. There are provided four contact points through the interconnection of detents 72 which engage the continuous annular groove 26. There are two contacts provided with engagement of wiping detents 74 with the pin plug assembly outer surface. Finally, there is the engagement of pin 30 with contact 58 as pin 30 is received within split ring 60.

In the configuration shown in FIG. 2, the radio pin 30 is in a secured centered position making for a secure wiping electrical contact. The connections between the contact sleeve 70 and the pin plug assembly outer surface serve as ground connections between the cable and the device to which the connector is secured. As noted above, the contact 58 includes a split-ring portion 60 which allows for an interference fit between the split-ring portion and the radio pin 30.

The dimensions of the contact sleeve, the pin plug assembly, and the socket assembly are carefully maintained to eliminate wobble in these members as the connection is made. Accurate centering of the inner conductor of the coaxial cable is maintained at all times when the connector of this invention is assembled.

While in the preferred embodiment the cable sleeve 20 is substantially cylindrical, alternate embodiments of the sleeve may be utilized including sleeves with multiple outside diameters. An example of a modified sleeve is one in which a series of stepped diameters are employed with the smallest diameter at the flange 39 and an intermediate diameter provided adjacent the smaller outer flange diameter which intermediate diameter is slightly smaller than the opening 52. Such a stepped diameter serves to retard cocking of the pin in the socket.

Upon detachment, the pin assembly A is pulled from the socket assembly B. The contact sleeve 70 is maintained within the socket's hollow region 56 due to the inwardly curved opening 52 of the metal sleeve 50. Upon moving forward, contact sleeve 70 will engage the inwardly curved opening 52. This will stop the insert sleeve 70 from moving forward and maintain it within the socket's defined hollow region 56. Alternate structures may be used to define a reduced opening such as selective crimping or staking of the sleeve 50 at the end thereof. As stated previously, the amount of force necessary to insert the pin assembly A in comparison to the amount of force necessary to disassemble the coupling can be varied. This is accomplished by varying the angles of the ramps of the detents as discussed in connection with FIGS. 7 and 10 and also varying the radius of the detents as discussed in connection with FIG. 8.

The preferred embodiment has been described in relationship to a radio pin assembly with a coaxial cable and a socket assembly. It is to be appreciated that other embodiments including in-line cable connecting assemblies, pin-to-socket assemblies and socket-to-pin assemblies, cable-to-antenna assemblies and cable-to-device assemblies may also take advantage of the present invention.

Modified Form of the Invention

Figure 9:
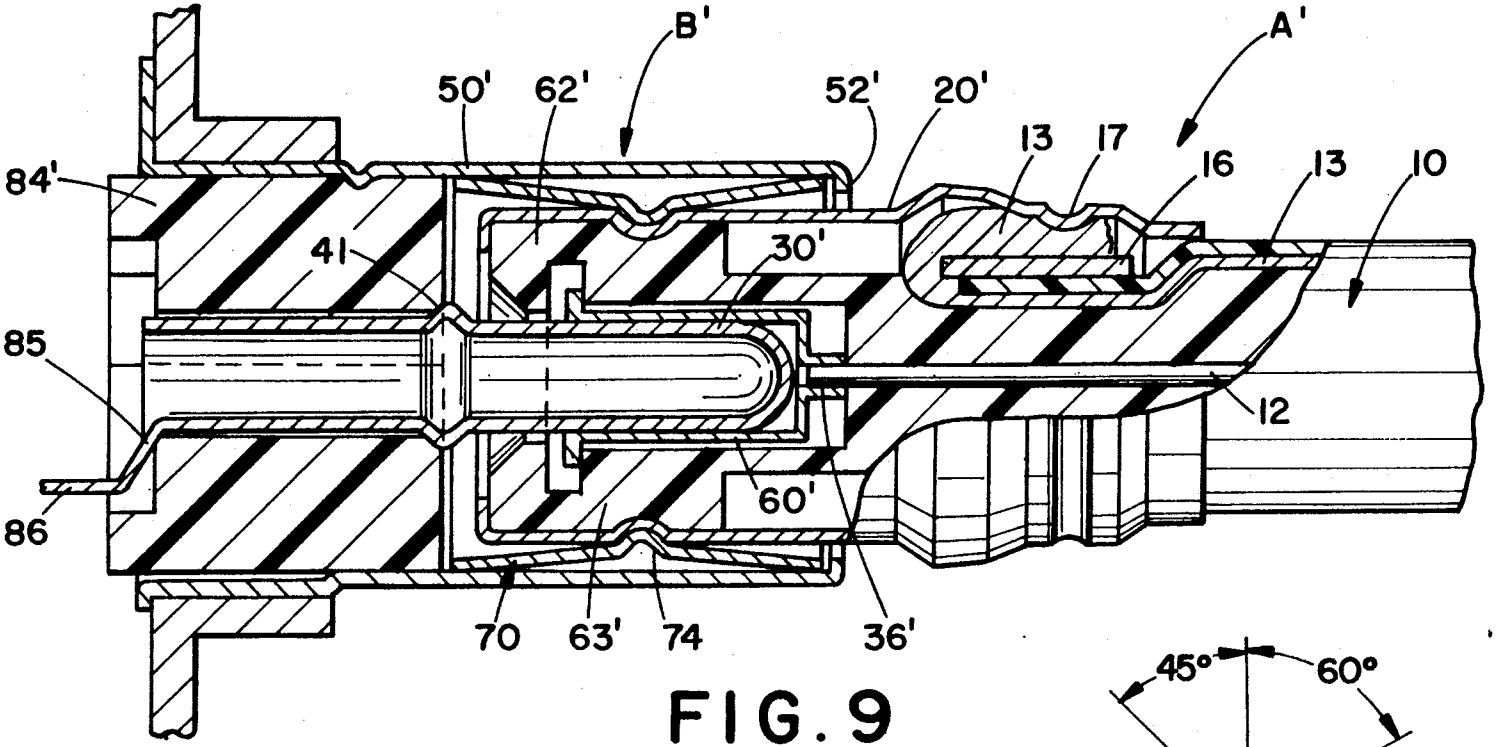
FIG. 9 is a modified form of the invention in side elevational view with selected portions broken away illustrating a pin socket assembly interconnected with a plug assembly; and, FIG. 10 is a view similar to FIG. 7 but showing a modified form of the spring contact.

A modified form of the invention is shown in FIG. 9. Whereas in the description of the preferred embodiment of the invention, the radio pin 30 forms a part of the pin plug assembly A, the modified form of the invention as shown in FIG. 9 incorporates the radio pin as a part of the socket assembly. In describing the modified form of the invention, similar reference characters will be used, where possible, as were used in connection with the description of the preferred embodiment.

In the connector of FIG. 9, a plug assembly $A^1$ is shown interconnected with a pin socket assembly $B^1$.

Plug assembly $A^1$ of FIG. 9 includes a cable sleeve $20^1$ which is mechanically secured to coaxial cable 10 by crimping at 17. An electrical interconnection between the outer conductive sheath 13 and the cable sleeve $20^1$ is afforded by means of the use of a grounding sleeve 16 which is captured in place by the crimp 17.

Disposed within cable sleeve $20^1$ are insulation members $62^1$, $63^1$. A split-ring $60^1$ is held in place by he insulation members $62^1$, $63^1$. Inner conductor 12 of the coaxial cable 10 is crimped to split-ring $60^1$ at $36^1$. A radial clearance is provided between split-ring $60^1$ and insulation members $62^1$, $63^1$ in order to permit a slight, outward expansion of split-ring $60^1$ upon insertion of radio pin $30^1$.

Socket assembly $B^1$ of FIG. 9 includes sleeve $50^1$ defined by a turned-in anterior opening 52. Received within the interior of sleeve $50^1$ is a contact sleeve 70 which includes a plurality of detents 74. The detents of 74 of FIG. 9 may be in the configuration shown in FIG. 7 or, alternately, in the configuration shown in FIG. 8. Still further, the detents can be a mixture of the designs of detents shown in FIGS. 7 and 8 or variations thereof.

As shown in FIG. 9, a radio pin $30^1$ is secured within socket assembly $B^1$ by insulation members 84, $84^1$. Radio pin $30^1$ is secured within insulation members 84, $84^1$ as these members are captured between outwardly-projecting rib 41 and an outwardly-directed flange 85 from which a tail 86 extends.

Locking engagement of the plug assembly $A^1$ with the pin socket assembly $B^1$ of FIG. 9 is accomplished in much the same manner as that described in connection with FIGS. 1 and 2 above. Further description of the locking engagement is not believed to be necessary. The embodiment of FIG. 9 essentially provides for a reversal of the radio pin 30 and the contact 58 which includes the split ring 60. In all other respects, the operation of the connector of FIG. 9 is identical to that described in FIGS. 1 and 2 above.

The invention has been described with reference to the preferred embodiment and a modified embodiment. Obviously, modifications and alterations will occur to others upon reading and understanding this specification. It is intended to include all such modifications and alterations insofar as they come within the scope of the appended claims or the equivalents thereof.

What is claimed is:

1. A detachable coaxial cable connector comprising:

a plug pin assembly comprising, a coaxial cable with inner and outer electrical conductive material separated by dielectric insulating material, a cable sleeve having an extension with an annular groove, said cable sleeve maintaining a secure electrical interface with said outer electrical conductive material, a pin with a section for receiving the inner conductive material of said coaxial cable, the inner electrical conductive material being maintained in a secured electrical interface with respect to said pin, and insulation support means for insulating against electrical signals passing between said cable sleeve and said pin and for securing said pin to said pin plug assembly; and, a socket assembly for receiving said plug pin assembly, said socket assembly and said plug pin assembly, when assembled, forming a plurality of mechanical and electrical connections between said plug pin assembly and said socket assembly, said socket assembly comprising, a metal sleeve extending substantially the length of said socket assembly, said metal sleeve having a reduced opening, a generally cylindrical split ring contact sleeve having axially extending circumferentially spaced portions which are radially resilient and which are interconnected to first and second axially spaced end sections, the first and second end sections having substantially the same diameter, in a relaxed state which is larger than the diameter of said reduced opening and a diameter in a compressed state which is less than the diameter of said reduced opening thereby facilitating the insertion and removal of said contact sleeve from said metal sleeve, said circumferentially spaced portions and said first and second axially spaced end sections being defined by a single layer, of electrically conductive material, and a plurality of detents carried by said axially extending circumferentially spaced portions between the first and second end sections and spaced around its circumference, said contact sleeve confined in and impinging upon the interior of said metal sleeve in electrical contact therewith, said plurality of detents engaged with said annular groove forming an electrical and mechanical joint with said plug pin assembly, and, an insulated contact for contacting said pin at one location and for contacting a device at another location.

2. The apparatus as set forth in claim 1 wherein said circumference of said contact sleeve is such that said contact sleeve engages said metal sleeve at its reduced opening.

3. The apparatus as set forth in claim 1 wherein the split ring contact sleeve is made of a thin flexible metallic material which maintains its strength of engagement with the annular groove after repetitive insertions and extractions.

4. The apparatus as set forth in claim 1 wherein the detents are spaced around the circumference in an arrangement such that each of the detents provide equivalent engaging pressure to the annular groove.

5. The apparatus as set forth in claim 1 wherein the detents of said split ring contact sleeve further include angles that are non-symmetrical.

6. The apparatus set forth in claim 1, wherein the detents of said contact sleeve further include angles that are symmetrical.

7. A detachable coaxial cable connector comprising:

a plug assembly comprising:

a coaxial cable with inner and outer electrical conductive material separated by dielectric insulating material;

a cable sleeve having an extension with an annular groove, said cable sleeve maintaining a secure electrical interface with said outer electrical conductive material;

a socket assembly for receiving said plug assembly for forming a plurality of mechanical and electrical connections between said plug assembly and said socket assembly said socket assembly comprising:

a metal sleeve extending substantially the length of said socket assembly, said metal sleeve having a reduced opening;

a generally cylindrical split ring having first and second axially spaced ends and an intermediate detent portion disposed between the first and second ends, the first and second ends having substantially the same diameter, said circumferentially spaced portions and said first and second axially spaced end sections being defined by a single layer of electrically conductive material, in a relaxed state which is larger than the diameter of said reduced opening and a diameter in a compressed state which is less than the diameter of said reduced opening thereby facilitating the insertion and removal of said contact sleeve from said metal sleeve, the split ring radially confined in and impinging upon the interior of said metal sleeve the detents capable of radial movement to engage the annular groove;

a pin; and, a contact for contacting said pin;

a means to connect said inner conductive material of said coaxial cable with either one of said pin or said contact; and a means to connect either one of said contact or said pin to a device said pin and said contact being located in either one of said plug assembly or said socket assembly there being provided means for insulating against electrical signals passing between said cable sleeve and said pin and said cable sleeve and said contact.

8. The detachable electrical connector as set forth in claim 7, wherein said pin is supported interiorly of said socket assembly and said contact is supported interiorly of said plug assembly with said inner conductive material of said coaxial cable in electrical contact with said contact and said pin in electrical contact with a connected device.

9. The detachable coaxial cable connector of claim 7, wherein the connector is of an in-line type for joining two coaxial cables.

* * * * *